United States Patent [19]

Bock et al.

[11] 4,336,683

[45] Jun. 29, 1982

[54] MECHANISM FOR THE PRODUCTION OF A WRAPPED YARN

[75] Inventors: Erich Bock; Burkhard Wulfhorst, both of Ingolstadt; Eugen Hini, Lenting; Bernhard Grupp, Ingolstadt, all of Fed. Rep. of Germany

[73] Assignee: Schubert & Salzer

[21] Appl. No.: 113,507

[22] Filed: Jan. 21, 1980

[30] Foreign Application Priority Data

Jan. 23, 1979 [DE] Fed. Rep. of Germany ..... 2902404

[51] Int. Cl.[3] ..... D02G 3/36; D01H 7/18; D01H 11/00

[52] U.S. Cl. ..... 57/18; 57/352; 57/354

[58] Field of Search ..... 57/16–18, 57/304, 352, 354

[56] References Cited

U.S. PATENT DOCUMENTS

| | | | |
|---|---|---|---|
| 3,060,673 | 10/1962 | Anderson et al. | 57/304 X |
| 3,412,545 | 11/1968 | Lippuner | 57/304 |
| 3,857,228 | 12/1974 | Nakahara et al. | 57/304 |
| 4,018,042 | 4/1977 | Maag et al. | 57/18 X |
| 4,129,979 | 12/1978 | Hamel | 57/304 X |
| 4,170,101 | 10/1979 | Bock | 57/18 X |
| 4,226,077 | 10/1980 | Hilbert | 57/18 |

*Primary Examiner*—John Petrakes

[57] ABSTRACT

A mechanism for the production of wrapped yarn which consists of a bundle of spun fibers wrapped around a binding thread. A hollow spindle 5 is supported between a pair of delivery rolls 1, 2 and a pair of draw-off rolls 3, 4. A rotating binding thread bobbin 7 is arranged coaxially with the hollow spindle 5 and is enclosed by a housing 8. An air flow which can be generated in the housing and/or introduced into the housing causes the pressure within the housing to be built up so as to prevent fibers and the like from entering an exit hole carried in a cover 80 provided on the housing.

8 Claims, 6 Drawing Figures

MECHANISM FOR THE PRODUCTION OF A WRAPPED YARN

BACKGROUND OF THE INVENTION

The present invention refers to a mechanism for the production of a wrapped yarn which consists of a bundle of spun fibers wrapped round by a binding thread, having a hollow spindle supported between a pair of delivery rolls and a pair of draw-off rolls, a rotating binding-thread bobbin arranged coaxially with the hollow spindle and a housing surrounding the binding-thread bobbin.

A mechanism of the above-mentioned kind for the production of a wrapped yarn is known, in which the housing acting as a balloon-restricter turns at the same angular velocity as the binding-thread bobbin (West German A/S No. 2.428.483=U.S. Pat. No. 4,018,042). The binding thread, here a filament, is wound round the core of a flanged bobbin which prevents the layers of thread from slipping down off the wound body and to that extent is particularly advantageous. Through the rotation of the binding-thread bobbin arranged on the driven hollow spindle and connected fixedly in rotation to it, the bundle of spun fibers delivered by the pair of delivery rolls into the hollow spindle gets wrapped round by the binding-thread and subsequently the finished wrapped yarn is drawn down out of the hollow spindle by the draw-off rolls. Upon drawing the binding-thread off the rotating flanged bobbin which is effected with the formation of a thread balloon, a thread tension is generated so that the binding-thread is wound round the bundle of spun fibers under tension and makes it firm. The thread tension of the binding-thread which depends for its average value upon the speed of rotation of the bobbin body and the fineness of the binding-thread and alters in dependence upon the shape and size of the binding-thread bobbin, influences the yarn structure and according to the known proposal must not be too high.

In continuous operation it has proved disadvantageous that after leaving the pair of delivery rolls fibers detach themselves from the bundle of spun fibers. These as well as other fluff usual in spinning mills can arrive in the region of the rotating binding-thread, get caught by it and accumulate on it. Especially in the case of smooth binding threads the fibers loop themselves round it and get held on the thread balloon by the high centrifugal force between the point of wrap and the greatest diameter of the balloon, where finally a fiber beard forms. In that case the binding thread slides at its draw-off speed through the fiber beard without pulling it with it. Because of the increased centrifugal force as well as the increased air resistance through the fiber beard an increase in the binding-thread tension occurs. A further increase in the binding-thread tension is caused when the fiber beard the binding-thread balloon collapses and hence rubs against the bobbin with the binding-thread. Such an increase in the thread tension in the binding-thread is undesirable since as mentioned above it influences the yarn structure and also the technological characteristics of the yarn, in particular the ultimate strength and thereby has a disadvantageous effect upon the yarn quality.

Under certain circumstances through the formation of the fiber beard it may even come to yarn breakage and hence to an interruption of the spinning process. The escape of the fibers from the fiber formation cannot be completely prevented if a false twist is imparted to the bundle of spun fibers before the entry into the hollow spindle.

Besides these technological disadvantages the increased consumption of energy of the housing running round with the binding-thread bobbin has proved disadvantageous.

The object of the present invention is to avoid these disadvantages and to create a mechanism which enables the production of a wrapped yarn satisfactory in quality while at the same time reducing consumption of energy.

SUMMARY OF THE INVENTION

This problem in the case of a mechanism constructed in accordance with the invention is solved in the way that the housing is arranged stationary and is closed by a cover exhibiting a drilled hole lying concentric with the hollow spindle and that by an airflow which can be generated in the housing and/or introduced into the housing an air pressure is built up in the housing in the region of the hole, the level of which is at least equal to the outside pressure surrounding the hole.

A pneumatic seal is thereby achieved between the housing and the spindle which prevents the fibers from coming through the drilled hole into the housing and being able to accumulate on the binding-thread.

For the generation of an airstream flowing inside the housing in the direction towards the hole in the cover, the side of the cover next the inside of the housing exhibits a structure which breaks up an air vortex. In a further refinement of the mechanism an airflow through the hole drilled in the cover towards the outside is achieved by the cover having a double head and there being air passages in the head which lies next to the binding-thread bobbin. A reinforcement of this airflow in the case of a mechanism having a flanged bobbin containing the binding-thread is made possible by at least one air inlet opening which extends inside the housing and lies with its mouth near to the bobbin flange of the flanged bobbin remote from the cover of the housing and at an internal diameter of the housing which is considerably less than the diameter of the bobbin flange.

The introduction of an airflow into the housing is made possible by a compressed air pipe which can be connected to the housing. By the fact that the hollow spindle projects above the cover and the hole drilled in the cover is the passageway for the binding thread, the deposit on the cover of fibers which have become free is favored. In order to prevent fibers lying on the cover from being caught by the binding-thread and carried along with it, the cover carries a little protective tube surrounding the drilled hole. The cleaning of deposits off the cover by the suction tube belonging to the delivery rolls is made possible by the cover being supported to be able to rotate.

Accordingly, it is an important object of the present invention to provide a mechanism which enables the production of wrapped yarn satisfactory in quality while at the same time minimizes consumption of energy.

Still another important object of the present invention is to provide a mechanism which enables the production of wrapped yarn with a minimum of interference from loose fibers and fluff.

These and other objects and advantages of the invention will become apparent upon reference to the following specification, attendant claims and drawings.

DESCRIPTION OF A PREFERRED EMBODIMENT

Figure 1:
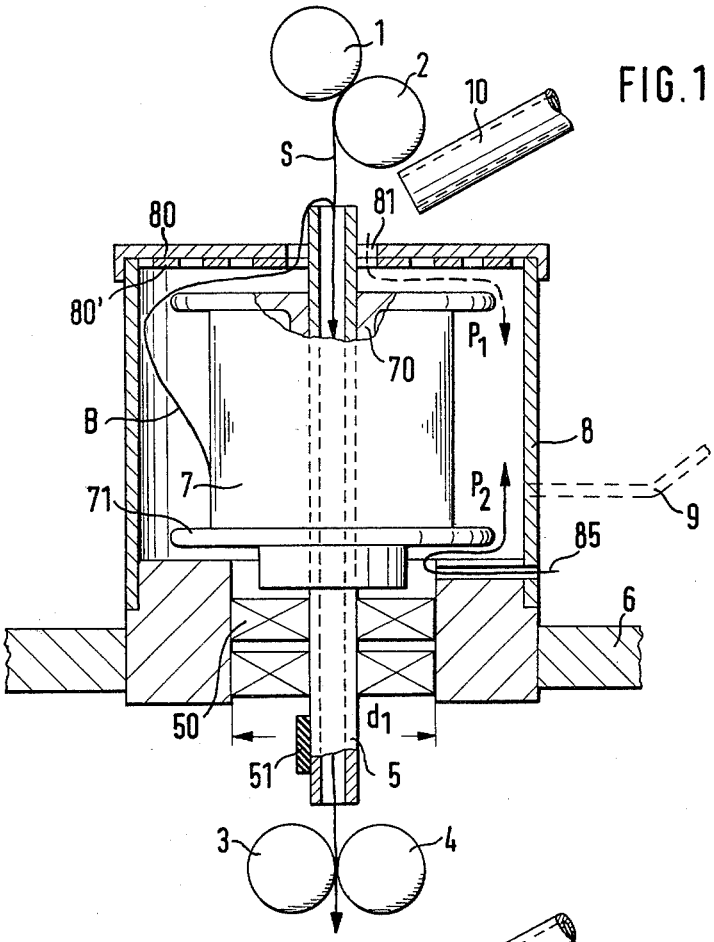
FIG. 1 illustrates a wrapping mechanism having a stationary housing, partially in longitudinal section.

Between a pair of delivery rolls, 1, 2 and a pair of draw-off rolls 3, 4 a hollow spindle 5 is supported rotatably in a machine frame 6 by means of a bearing 50 (FIG. 1). A flanged bobbin 70 is arranged on the hollow spindle 5 and connected to it fixedly in rotation, round the core of which is wound a binding-thread B and which is designated below as the binding-thread bobbin 7. A filament, a yarn or a twist serves as the binding-thread B. Upon driving the hollow spindle 5, for example, by means of a tangential belt 51, the binding-thread bobbin 7 revolves with the hollow spindle 5.

The binding-thread bobbin 7 is enclosed in an essentially axially symmetrical housing 8 arranged coaxially with it and spaced therefrom. The housing 8 is fastened directly or indirectly via the bearing 50 to the machine frame 6 or is an integral component of the machine frame. A cover 80 is mounted on the stationary housing 8 and has a central drilled hole 81 lying in prolongation of the longitudinal axis of the hollow spindle 5. The hollow spindle 5 extends through the hole 81 in the direction towards the pair of delivery rolls 1, 2, so that its inlet opening for the bundle S of spun fibers delivered by the pair of delivery rolls 1, 2 and for the binding-thread B running off the binding-thread bobbin 7 lies outside the closed housing 8. The diameter of the drilled hole 81 is a little more than the outer diameter of the hollow spindle 5 so that an adequately large gap exists between the surface of the hollow spindle 5 and the wall of the hole 81 for the binding-thread B to leave the housing 8. Upon leaving the housing 8 the binding-thread B is deflected at the wall of the hole 81 in the direction towards the inlet opening to the hollow spindle 5. In order to enable access to the binding-thread bobbin 7 the cover 80 is removable from the housing 8.

Figure 4:
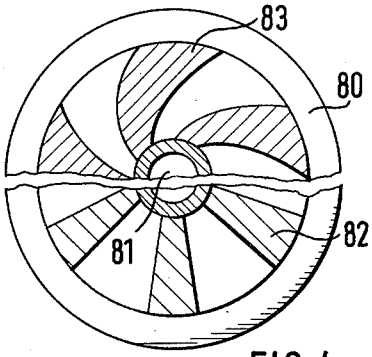
FIGS. 4 and 5 are plan views of two cover halves and a cover having a structure which breaks up an air vortex.
Figure 5:
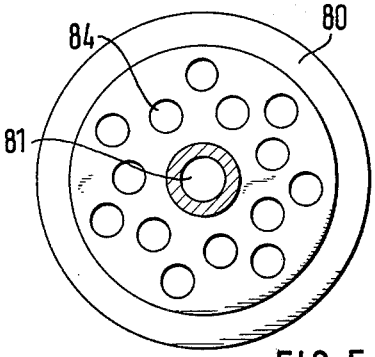

The side of the cover 80 next the inside of the housing 8 has a structure 80' which is suitable for breaking up air vortices. Such a structure if it has not already been machined in the cover 80 during production of it is created on the cover in a simple way by gluing on suitable profiles, for example, webs 82 or guide blades 83 in the form of a fanblade (FIG. 4). A perforated metal sheet 84 in accordance with FIG. 5 which is glued to the cover or fastened to it in some other way also fulfills the desired purpose.

The housing 8 has near to the bobbin flange 71 of the flanged bobbin 70 remote from the cover 80 an air inlet opening 85 which extends into the interior of the housing. The arrangement is formed so that the mouth of the air inlet opening 85 lies at an inner diameter $d_1$ of the housing 8 which is considerably smaller than the diameter of the bobbin flange 71. If necessary a number of such air inlet openings 85 may also be provided, the mouths of which lie in a vertical plane overlapped by the bobbin flange 71.

As already stated initially, in continuous operation on the portion of the path between the pair 1, 2, of delivery rolls and the inlet opening to the hollow spindle 5, fibers and fragments of fiber become detached from the bundle S of spun fibers. These fibers which have become free or else fluff present in the atmosphere is now largely deposited on the cover 80. In particular, fibers which are detached from the fiber formation at the inlet opening to the hollow spindle 5, because of their kinetic energy cross the relatively narrow gap between the hollow spindle 5 and the wall of the hole 81 and are deposited on the cover 80. But it cannot be excluded that individual fibers of those that have become free arrive at this gap. In the case of a housing without the airflow conditions created by the invention and further explained below, they would then be conveyed with an airflow $P_1$ into the interior of the housing 8 and be laid round the binding-thread B in the way described at the beginning. The airflow $P_1$ which enters through the hole 81 into the housing 8 is generated by the rotation of the binding-thread bobbin 7 and leaves the housing at a point of leakage, for example, at the bearing 50 of the hollow spindle 5.

The entry of the fibers into the housing is prevented by the generation of an airflow $P_2$. Caused by the rotation of the bobbin flange 71 and the reduced pressure as compared with the ambient pressure, prevailing in the region of the mouth of the air inlet opening 85 as well as by the structured face of the cover 80, the airflow $P_2$ flows through the air inlet opening 85 into the housing 8 and further in the direction towards the cover 80 where it can pass again into the open through the hole 81. In the region of the hole 81 drilled in the cover 80 an air pressure is in that case built up which is at least equal to the outer pressure surrounding the hole 81. Hence the arising of an airfow $P_1$ is prevented. The airflow $P_2$ acts as a seal.

The magnitude of the air pressure at the hole 81 depends upon the parameters prescribed by the wrapping mechanism to which belong the speed of rotation and size of the flanged bobbin 70, the distance of the flanged bobbin 70 from the cover 80 and from the bottom of the housing 8 as well as the diameter of the housing 8. The airflow $P_2$ is further reinforced if near to the air inlet opening 85 a fanblade similar to that shown in FIG. 4 for the structuring of the cover 80 is connected fixedly in rotation to the flanged bobbin 70.

Air inlet openings 85 on the housing can if necessary be waived if the bearing 50 allows the entry of an airflow into the housing 8. In this case, the structured cover 80 or else a cover 800 having a double head (FIG. 3) is adequate for generating a sufficiently strong airflow $P_2$ for the buildup of an air pressure in the housing 8 in the region of the hole 81, which is at least equal to the outer pressure surrounding the hole.

Figure 3:
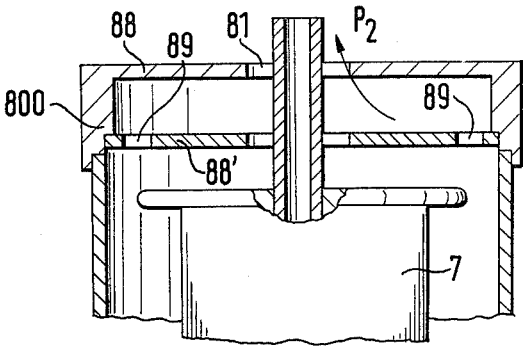
FIG. 3 is a cover having a double head, in longitudinal section.

The above-mentioned cover 800 which in FIG. 3 closes the housing 8 has two heads 88 and 88'. The head 88' lying next to the binding-thread bobbin 7 has drilled holes 89. With the cover 800 made in such a way a zone of quiet air is created between the two heads 88 and 88' and a flow of air $P_2$ outwards through the hole 81 is achieved. This flow of air $P_2$ which brings about an over-pressure in the region of the hole 81 is further reinforced by one or more air inlet openings 85 (FIG. 1). Structuring of the side of the head 88' next to the inside of the housing 8 is in this case not absolutely necessary.

Figure 2:
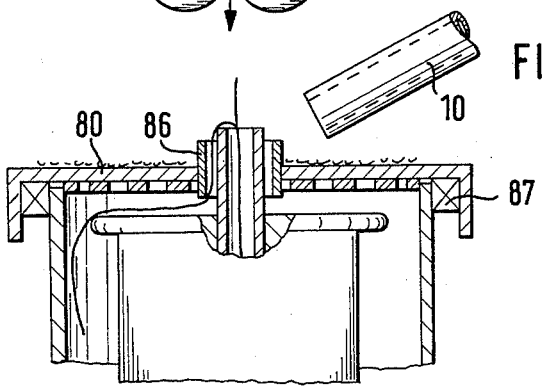
FIG. 2 is a cover having a little protective tube, supported rotatably on the housing, in longitudinal section.

In order to prevent fibers lying on the cover 80, from straying towards the hole 81 because, for example, of airflows existing in the ambient, being caught there by the binding-thread B and carried along with it into the hollow spindle 5 and then impairing the appearance of the finished wrapped yarn a little protective tube 86 is provided (FIG. 2). This is fastened onto the cover 80 or integrated into the cover and surrounds with clearance between, the hollow spindle 5 projecting out of the housing 8. In addition to the arrangement of a little protective tube or independently of it, cleaning of deposits from the surface of the cover 80 may be effected and for doing this the existing suction tube 10 may be employed. In order to bring all of the regions of the cover 80 within the range of suction of the suction tube 10, the cover 80 is supported to be able to rotate, which is indicated by a bearing 87 and is set in rotation by a positive drive or merely by the oscillations of the machine.

Figure 6:
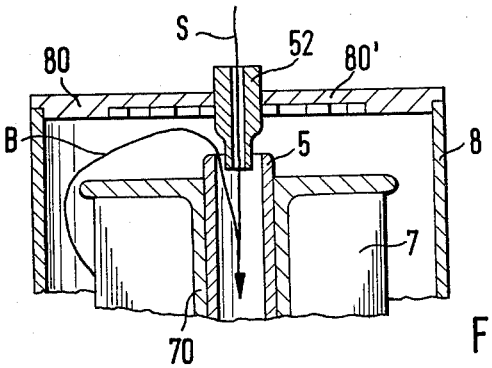
FIG. 6 is a longitudinal sectional view of a hollow spindle having an inlet opening lying inside the housing.

The build-up of an air pressure in the region of the point of transition between the cover and the hollow spindle, which is equal to or greater than the outer pressure is advantageous even in the case of a mechanism in which the inlet opening to the hollow spindle 5 lies inside the housing 8 and the feeding of the bundle of spun fibers into the hollow spindle 5 is effected without further auxiliary means through a hole drilled in the cover, which is adapted to the diameter of the bundle of spun fibers or as is shown in FIG. 6 through a guide tube 52 fastened to the cover 80, which projects a little way into the hollow spindle 5. The air vortices which arise in the housing 8 are here too broken by a suitable structure 80' which is provided on the side of the cover 80 next the inside of the housing 8.

The generation of an adequate airflow $P_2$ in the housing itself as has been described above, occurs in particular in the case of a mechanism having a flanged bobbin with at least one bobbin flange which lies near to the air inlet opening 85. But the build-up of an air pressure in the region of the hole 81, which is at least equal to the outer pressure, is possible even when the binding-thread B is wound onto a pirn. In this case, the airflow necessary to the generation of the airflow $P_2$ in the direction towards the hole is introduced into the housing 8 through a compressed air pipe 9 connected to a compressed air generator (not shown), as is indicated in FIG. 1. The compressed air may be introduced into the housing at any point in it, for example, even at the air inlet opening 85. Obviously the introduction of a flow of compressed air into the housing 8 is possible even in the case of the employment of a flanged bobbin and may if necessary be effected even in addition to the generation of an airflow in the housing.

A further possibility for the generation of an air-flow $P_2$ consists in maintaining in an air pressure chamber (not shown) which additionally surrounds the hole in the cover, an air pressure which is lower than the air pressure in the interior of the housing 8 near to the shank of the hollow spindle 5 and in air being sucked through the hole 81 in the cover 80 into this air pressure chamber via air inlet openings fitted to the housing 8.

The spinning conditions are not impaired by the construction of the wrapping mechanism in accordance with the invention in combination with a stationary housing. On the contrary by reduction of the housing 8 to an internal diameter which is less than a free-swinging thread balloon of the binding-thread a restriction of the balloon can be achieved. Surprisingly, it has proved that in that case melting of a filament employed as a binding-thread does not occur. By appropriate reduction of the housing 8 a further saving of energy is also achieved.

While a preferred embodiment of the invention has been described using specific terms, such description is for illustrative purposes only, and it is to be understood that changes and variations may be made without departing from the spirit or scope of the following claims.

What is claimed is:

1. A mechanism for the production of a wrapped yarn which consists of a bundle of spun fibers wrapped round by a binding thread, having a hollow spindle supported between a pair of delivery rolls and a pair of draw-off rolls, a rotating binding-thread bobbin arranged coaxial with the hollow spindle and a housing surrounding the binding-thread bobbin, said binding-thread bobbin having a radially extending flange adjacent a lower end thereof, said mechanism comprising:

means for stationarily supporting said housing relative to said rotating binding-thread bobbin;

a cover (80) closing said housing and having a hole (81) lying concentric with said hollow spindle (5);

an airflow ($P_2$) being fed into said housing (8) building the pressure in the region of said hole (81) to a level at least equal to the outside pressure surrounding said hole (81); and at least one inlet air opening (85) through which said air flow ($P_2$) is fed which extends inside the housing (8) and lies with its mouth near to said bobbin flange (71) adjacent a lower end of said bobbin (70) remote from the cover (80) of the housing (8).

2. The mechanism as set forth in claim 1 further comprising:

means carried on an inner surface of said cover inside said housing (8) for breaking up an air vortex.

3. The mechanism as set forth above in claim 1 further comprising:

said cover (800) having a double head with air passages (89) in the head (89') which lie next to said binding-thread bobbin (7).

4. The mechanism as set forth in claim 1 further comprising a fanblade (6) is carried by said flange bobbin for rotating therewith and being positioned adjacent to said air inlet opening (85).

5. The mechanism as set forth in claim 1 further comprising a compressed air pipe (9) for feeding said air flow to said housing (8).

6. The mechanism as set forth in claim 1 further comprising:

said hollow spindle (5) projecting above said cover (80) and the hole (81) drilled in the cover (80) for the passageway for the binding-thread.

7. The mechanism as set forth in claim 1 above further comprising:

a small protective tube (86) surrounding said threaded hole (81) provided in said cover (80).

8. The mechanism as set forth above in claim 1 further comprising said cover being rotatably supported on said housing.

* * * * *